US005448789A

United States Patent [19]

Shirai

[11] Patent Number: 5,448,789

[45] Date of Patent: Sep. 12, 1995

[54] BOTTOM STRUCTURE OF A BED

[75] Inventor: Kunito Shirai, Togane, Japan

[73] Assignee: Paramount Bed Company Limited, Tokyo, Japan

[21] Appl. No.: 170,717

[22] Filed: Dec. 21, 1993

[30] Foreign Application Priority Data

Dec. 25, 1992 [JP] Japan ..... 4-089071

[51] Int. Cl.[6] ..... A47C 23/06

[52] U.S. Cl. ..... 5/613; 5/191; 5/236.1

[58] Field of Search ..... 5/613, 617, 188, 191, 5/236.1, 400, 401, 465

[56] References Cited

U.S. PATENT DOCUMENTS

| | | | |
|---|---|---|---|
| 137,718 | 4/1873 | Pullinger | 5/236.1 |
| 2,616,100 | 11/1952 | Weiner | 5/236.1 |
| 2,638,606 | 5/1953 | Austin | 5/236.1 X |
| 2,745,473 | 5/1956 | Boland | 5/236.1 X |
| 4,370,767 | 2/1983 | Fraser | 5/417 |
| 4,827,544 | 5/1989 | Husler | 5/231.1 |
| 5,233,709 | 8/1993 | Harry | 5/236.1 |

FOREIGN PATENT DOCUMENTS

| | | |
|---|---|---|
| 51-30716 | 9/1976 | Japan . |
| 54-26164 | 8/1979 | Japan . |
| 54-37594 | 11/1979 | Japan . |

*Primary Examiner*—Michael F. Trettel
*Attorney, Agent, or Firm*—Townsend & Banta

[57] ABSTRACT

The present invention provides a bottom structure for a bed having a lifting mechanism and plural parallel bottom strips connected sequentially by elastic strips, thus allowing the bottom to be bent. The elastic strips are curved in areas not in contact with the bottom strips so that the bottom structure can be adjusted in length.

7 Claims, 3 Drawing Sheets

BOTTOM STRUCTURE OF A BED

CROSS-REFERENCE TO RELATED APPLICATION

This application claims the priority of Japanese Patent Application No. 89071/1992 filed on Dec. 25, 1992, which is incorporated herein by reference.

BACKGROUND OF THE INVENTION

1. Field of the Invention

The present invention relates to a bottom structure for a bed which can be bent to a proper curvature while allowing a patient to continue feeling relaxed even though the bottom is being partially lifted.

2. Description of Related Art

Many of recent beds are equipped with a bottom lifting mechanism and various mechanisms are available. An ordinary liftable bed has a back bottom portion simply connected to a waist bottom portion. The waist bottom portion is simply connected to a leg bottom portion. When the back bottom portion is lifted, the joint between the back and waist portions acts as a pivot, (i.e. forming an actual fulcrum), and when the leg portion is lifted, the joint between the waist and leg bottom portions also as a pivot.

Therefore, as the back bottom portion is lifted up forming an angle, the angular space between the back and waist bottom portions near the joint is narrowed, and unless the angle fits the body of the patient in the bed, the waist, abdomen, and underside of the patient's legs are uncomfortably pressed by the mattress.

SUMMARY OF THE INVENTION

The present invention has achieved a solution to the above cited problem. The object of the present invention is to provide a bottom structure for a bed, which can be bent in appropriate curves to provide gentle curvature spaces at the bent portions of the bed so as to minimize any displeasing pressure points for the patient.

To solve the problem, the present invention provides a bottom structure for a bed having a lifting mechanism, comprising plural parallel bottom strips incorporated as components of the bottom structure and connected sequentially by elastic plates, thus allowing the bottom to be bent.

In the above bottom for a bed, the elastic plates may also be curved at portions not in contact with the bottom strips.

When the bottom structure is partially lifted, the parallel bottom strips are raised, forming a gentle curve since the elastic plates connecting the bottom strips become curved. If the intervals between the bottom strips are adjusted, the bending angle can be adjusted.

If the elastic plates are also curved at the portions not in contact with the bottom strips, they not only allow bending of the bottom structure, but also allow adjustment of the overall length of the bottom of the bed in a longitudinal direction.

| | Symbols |
|---|---|
| 1 | Bed |
| 2 | Bottom |
| 3 | Actuator |
| 4 | Back Lifting Arm |
| 5 | Knee Lifting Arm |
| 6 and 7 | Roller |
| 8 | Bottom Strip |
| 9 | Elastic Plate |
| 10 | Mattress |
| 11 | Flexible Sheet |
| 12 | Attachment Means |
| 13 | Gap |

DETAILED DESCRIPTION OF THE INVENTION

The bottom structure tier a bed of the present invention is described below in reference to the attached drawings.

Figure 1:
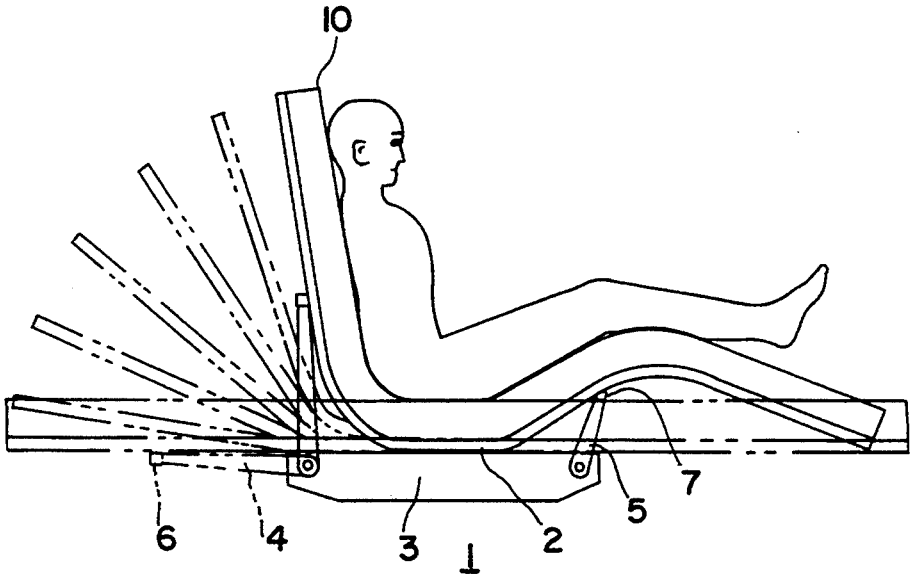
FIG. 1 is a side illustration showing a bed having the bottom structure of the present invention.

FIG. 1 shows a bed 1, having a bottom structure of the present invention. The bed 1 can be lifted at the back and knee portions by an electric actuator 3 provided below the bottom 2. The actuator 3 is provided with back lifting arms 4 for lifting the back portion and knee lifting arms 5 for lifting the knee portion. The back lifting arms 4 contact the bottom 2 on the underside at the portion corresponding to the back portion, through rollers 6 and the knee lifting arms 5 contact the bottom 2 on the underside at the portion corresponding to the patient's knees.

In this bed 1, the bottom strips 8 are sequentially attached by screws or any other appropriate means, to elastic plates 9 at predetermined intervals. This allows the bottom 2 to be bent at the bendable portion between the back and waist portions of the bottom 2 and at the portion corresponding to the patient's knees.

Figure 2:
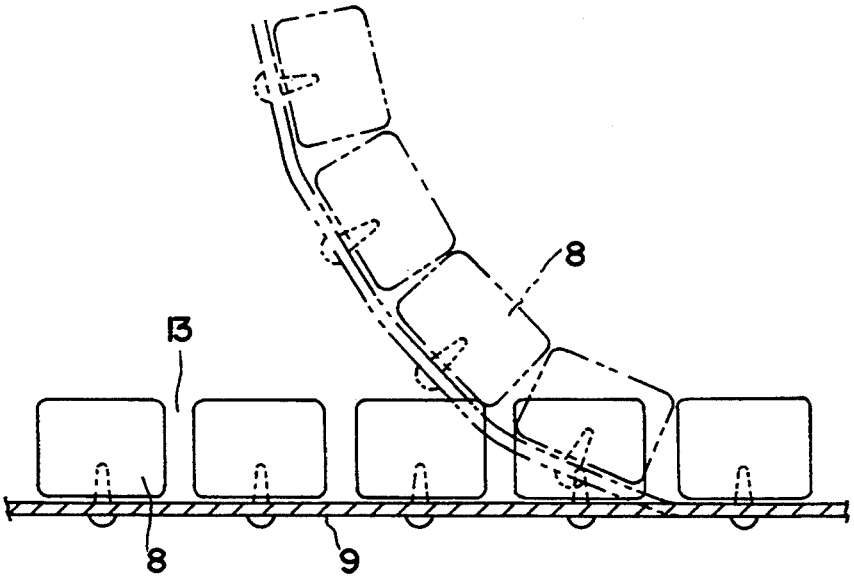
FIG. 2 is an enlarged sectional illustration showing one embodiment of the connecting structure of the bottom strips at a bendable portion of the bottom structure shown in FIG. 1.

In a bed 1, parallel bottom strips 8 may be screwed to elastic plates 9 at predetermined intervals. This allows the bottom 2 to be bent at the bendable portion between the back and waist portions of the bottom 2 and at the portion corresponding to the patient's knees (FIG. 2).

The bottom strips 8 may be made using moldable material or a rigid material such as wood. They may also be hollow if they are sufficiently rigid.

Figure 3:
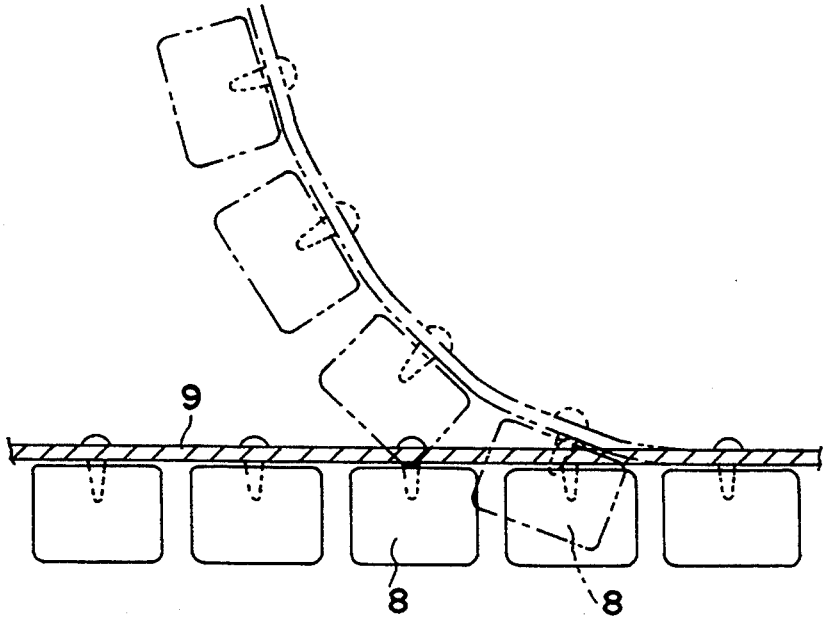
FIG. 3 is an enlarged sectional illustration showing another embodiment of the connecting structure of the bottom strips at a bendable portion of the bottom structure shown in FIG. 1.

The bottom strips 8 are attached to the elastic plates 9, either on the top side of the elastic plates of the bottom structure (see FIG. 2) or on the bottom side of the elastic plates (see FIG. 3), and are thus either interior or exterior respectively, to the curve formed by the elastic plate.

Figure 4:
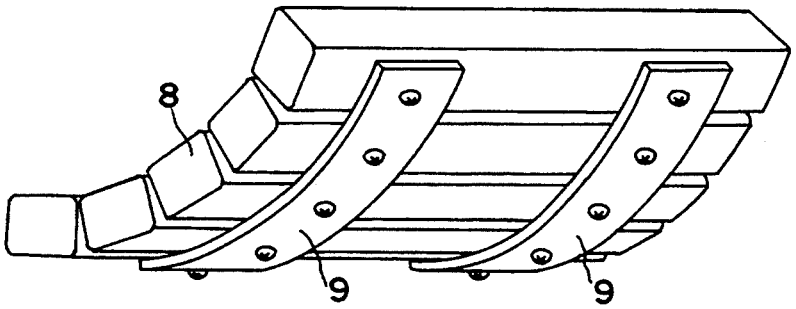
FIG. 4 is a schematic perspective illustration showing the curved state of the bottom strips of the bottom structure shown in FIG. 2.

The elastic plates 9 are preferably positioned near both ends of a bottom strip 8 and connected to the bottom strip by screws or any other appropriate means (see FIG. 4).

In the bed 1 with the above bottom structure, if the actuator 3 is started to partially lift the bottom 2, the parallel bottom strips 8 are raised, forming a overall gentle curve since the elastic plates 9 connecting the bottom strips 8 are also curved. In this case, if the intervals of the bottom strips 8 are changed, the angle of bend will also be adjusted.

Since the bottom is lifted at the back and waist portions, with the elastic plates having attached bottom strips 8 being raised to form a gentle curve, the waist, abdomen and the underside of the patient's legs will not experience any uncomfortable pressure by the bent portions of the mattress.

Since the bottom strips 8 and the elastic plates 9 can be of standardized size and shape and are simple in structure, they can be readily mass-produced and are advantageous in view of the cost of manufacturing.

A predetermined number of the bottom strips 8 can be screwed to the elastic plates 9. The plates are attached near both ends of the bottom strips at predetermined sequential intervals between the bottom strips, to form the bottom portions corresponding to the bendable portions of a bottom structure of a bed.

In this case, the number of the bottom strips 8 connected to the elastic plates can be changed and adjusted along the entire length of the bottom 2.

Further, if one of the bottom strips 8 or one of the elastic plates 9 is broken during use, only the broken part 9 need be changed, allowing easy maintenance.

Figure 5:
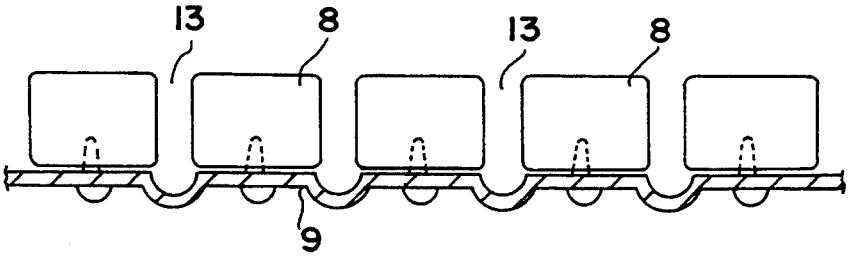
FIG. 5 is an enlarged sectional illustration showing a further embodiment of the connecting structure of the bottom strips of the present invention.

The bottom strips 8 and the elastic plates 9 can be formed as shown in FIG. 5. In this embodiment, the elastic plates 9 are curved at the portions not in contact with the bottom strips 8. The bottom 2 can not only be partially bent but also adjusted in overall length along the longitudinal direction of the bed.

Figure 6:
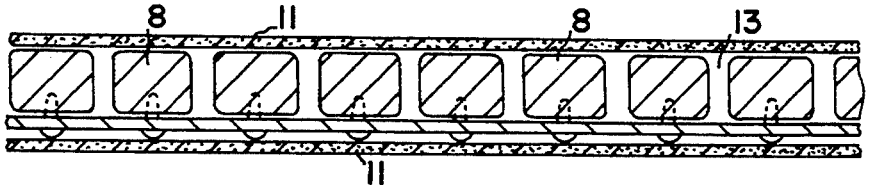
FIG. 6 is an illustration showing yet another embodiment where the bottom structure is covered with a flexible sheet.
Figure 7A:
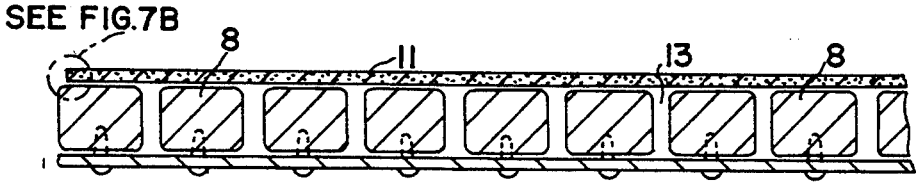
FIG. 7A illustrates a still further embodiment where a flexible sheet is attached to the upper surface of the bottom structure.
Figure 7B:
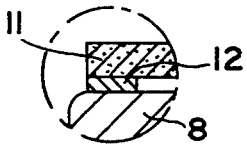
FIG. 7B is an enlarged sectional view of the circular area shown in FIG. 7A.
Figure 8A:
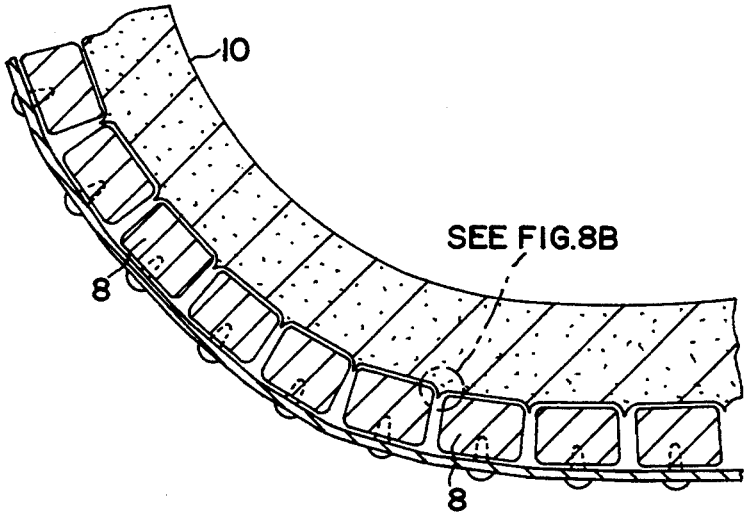
FIG. 8A illustrates an embodiment where a mattress is caught in the gaps of the bottom structure.
Figure 8B:
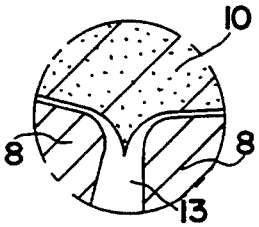
FIG. 8B is an enlarged sectional view of the circular area shown in FIG. 8A.

In the present invention, when the bottom structure is bent, a mattress 10 placed on the bottom structure might be caught in the gaps 13 formed between the bottom strips (see FIGS. 8A and 8B). To prevent this, the entire bottom may be covered with a flexible sheet 11 (see FIG. 6) or a flexible sheet 11 may be attached to the upper surface of the bottom structure (see FIGS. 7A and 7B).

The symbol 12 in FIGS. 7A and 7B shows a means for fixing or attaching the flexible sheet 14 to the bottom structure.

When the bottom structures in FIG. 2, FIG. 4 and FIG. 5 are bent, the gaps 13 formed on the upper side are pinched together. It may also happen that dust and dirt are collected in the gaps 13. However, if a flexible sheet 11 is provided, the accumulation of dust can be reduced or prevented. A flexible sheet 11 is preferably provided to permit easier cleaning. Further, it also prevents anything from being caught in the gaps formed during bending which might impair the function of the bottom structure.

As described above, the present invention provides the following effects:

1. Since parallel bottom strips of the same form are connected at bendable portions, the bottom can be lifted at the back and knee portions without giving any feeling of displeasing pressure.
2. Since the bottom strips and elastic plates can be standardized to be the same shape and form, they can be easily mass-produced and are advantageous in view of manufacturing costs.
3. If the intervals between the respective bottom strips are changed, the bend angle can be adjusted.
4. If the number of connected bottoms strips is changed, the length of the bottom can be changed.
5. If the elastic plates are curved at portions between the attached bottom strips, the bottom structure can be partially bent and the overall length in the longitudinal direction of the bed can be adjusted.
6. Even if one of the bottom strips or one of the elastic plates is broken during use, only the broken bottom strip or elastic plate need be changed, allowing for easy maintenance.
7. When a flexible sheet is used to cover the bottom structure, the structure is easier to clean and materials are prevented from impeding the function of the bottom structure during bending.

What is claimed is:

1. A bottom structure of a bed having a bottom lifting mechanism and comprising plural parallel bottom strips connected sequentially by elastic strips to allow the bottom to be bent as components of the bottom, said elastic strips being curved in areas between and not in contact with bottom strips.

2. A bottom structure for a bed having a bottom lifting mechanism comprising:

parallel bottom strips wherein said bottom strips have four faces;

at least one elastic strip wherein said elastic strip is in contact with one face of said bottom strips; and a means for attaching said bottom strips to said elastic strips, wherein said bottom strips are sequentially connected and secured by said attaching means to said elastic strips such that when a portion of said bottom structure is lifted a curve is formed, said elastic strips being curved at area between and not in contact with said bottom strips, such that said bottom structure can be adjusted in length.

3. A bottom structure according to claim 2 wherein said attaching means is a screw.

4. A bottom structure according to claim 2 wherein two elastic strips are in contact with said bottom strips and each elastic strip is located near each end of each bottom strip.

5. A bottom structure according to claim 2, wherein said bottom strips are attached on an upper surface of said elastic strips of the bottom structure, such that said bottom strips are interior to a curve formed when said bottom structure is lifted.

6. A bottom structure according to claim 2, wherein said bottom strips are attached on a lower surface of said elastic strips of the bottom structure, such that said bottom strips are exterior to a curve formed when said bottom structure is lifted.

7. A bottom structure according to claim 2, further comprising a flexible sheet covering at least one surface of said bottom strips.

* * * * *